US005692786A

United States Patent [19]

Berger

[11] Patent Number: 5,692,786

[45] Date of Patent: Dec. 2, 1997

[54] ELECTROMAGNETIC DOOR ASSEMBLY

[75] Inventor: Mark J. Berger, New York, N.Y.

[73] Assignee: Securitech Group, Inc., Maspeth, N.Y.

[21] Appl. No.: 700,615

[22] Filed: Aug. 16, 1996

[51] Int. Cl.[6] ..... E05C 19/16

[52] U.S. Cl. ..... 292/251.5

[58] Field of Search ..... 292/251.5, 144

[56] References Cited

U.S. PATENT DOCUMENTS

| | | | |
|---|---|---|---|
| 2,637,578 | 5/1953 | Gaona | 292/144 |
| 4,696,500 | 9/1987 | Zunkel | 292/251.5 |
| 4,826,223 | 5/1989 | Geringer et al. | 292/251.5 |
| 5,016,929 | 5/1991 | Frolov | 292/251.5 |
| 5,033,779 | 7/1991 | Geringer et al. | 292/251.5 |
| 5,065,136 | 11/1991 | Frolov et al. | 292/251.5 |
| 5,184,854 | 2/1993 | Chen | 292/251.5 |
| 5,376,910 | 12/1994 | Geringer et al. | 292/251.5 |
| 5,496,079 | 3/1996 | Frolov | 292/251.5 |
| 5,516,166 | 5/1996 | Frolov et al. | 292/251.5 |

*Primary Examiner*—Rodney M. Lindsey
*Attorney, Agent, or Firm*—Abelman, Frayne & Schwab

[57] ABSTRACT

An electromagnetic door lock and release mechanism is disclosed in which the electromagnet is contained within a separate sub-assembly which is electrically connected to the control circuitry by quick connect type of frictional contacts. Accordingly, the electromagnet portion of the system may be changed without requiring the maintenance person to have access to the wires that connect the electromagnetic door lock and release mechanism to its control circuitry. This advantageously permits replacement of the electromagnet without requiring the services of an electrician.

6 Claims, 4 Drawing Sheets

FIG. 3
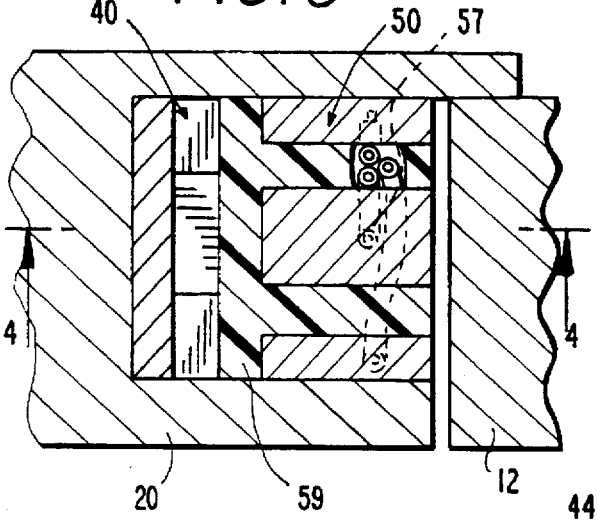
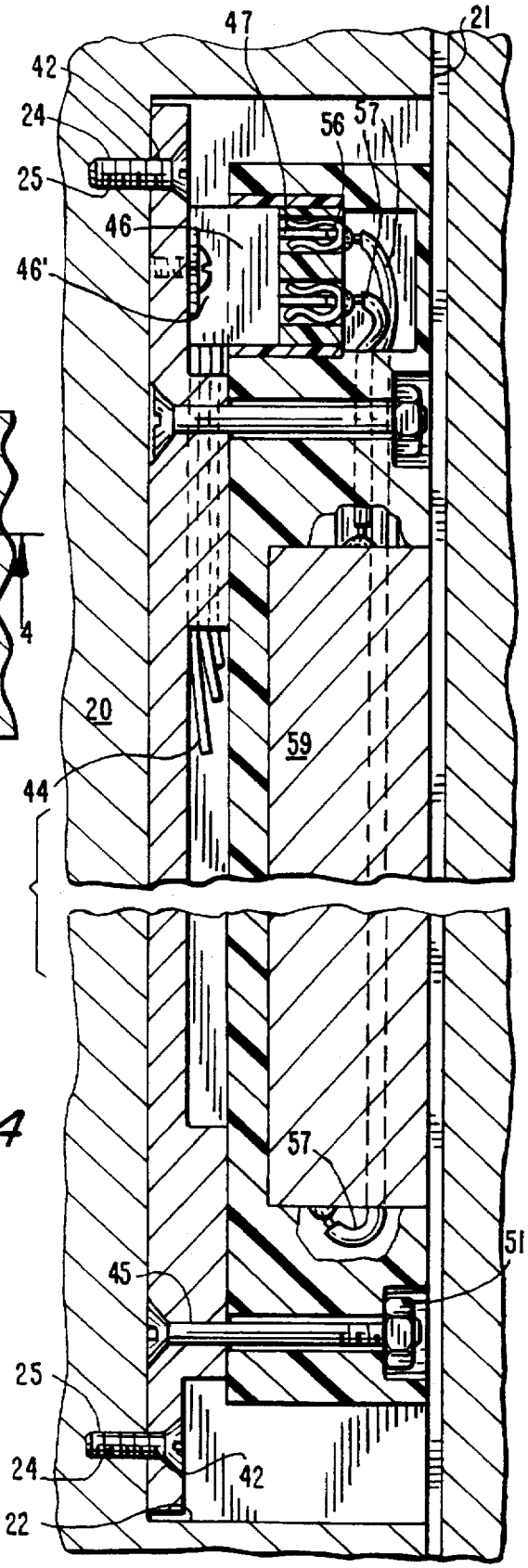
FIG.4

ELECTROMAGNETIC DOOR ASSEMBLY

FIELD OF THE INVENTION

The present invention relates to an electromagnetic door lock and release mechanism in which the electromagnet portion may be easily disconnected and replaced. The electromagnet is contained within a sub-assembly which is connected to the electrical control circuit via quick connect type of frictional contacts—e.g. a plug and complementary socket. Associated mechanical connecting means are provided for maintaining the electromagnetic sub-assembly in its desired operative position, while permitting ease of removal should replacement be required.

BACKGROUND OF THE INVENTION

Electromagnetic locks are generally employed to control egress and access through a door from a remote location. Such electromagnetic locks generally include an electromagnetic on the door frame, about which the door is hinged, with a cooperating magnetically responsive portion on the door. The electromagnet and the magnetically responsive portion of the door will customarily be in close proximity. When it is desired to maintain the door in its closed position, the electromagnet is energized, to maintain firm electromagnetic contact between the door frame and the door, of a sufficient force to prevent opening of the door. When it is desired to permit opening of the door, as by allowing egress through the door, the electromagnet is de-energized from an external control location. This will permit opening of the door. While electromagnetic operated door closures are used in a variety of locales, one such use for which the present invention has found particular utility is in a municipal subway system. The stations of such a system will oftentimes include a remotely controlled door entry. When it is desired to permit opening of the door, such control is typically governed by a station attendant at a location remote from the door (e.g. the station change booth).

It has been experienced that over extensive periods of use, the electromagnet may require replacement. The electromagnetic assembly is directly connected to the control signal transmitted to the door frame by wires extending out of the housing unit which contains the electromagnet such units are typically shown in U.S. Pat. Nos. 4,826,223; 5,065,136; and 5,133,581. In addition to the physical removal and substitution of a new electromagnet, the disengagement of the wires which connect the existing unit to the control circuitry must be replaced by electrical connection to the wires of the new unit. This has in the past required the services of an electrician, and possibly the de-energization of the circuitry to prevent the inadvertent causing of a short circuit should the wires touch.

Recognizing the need to simplify electromagnet replacement, and the level of skill necessary to perform this task, the present invention substantially simplifies the removal and replacement of the electromagnetic, while not requiring the services of an electrician.

SUMMARY OF THE INVENTION

The electromagnetic door and lock release mechanism of the present invention includes two cooperating housing members. A first of these members is recessed within the door frame, and include outwardly extending electrical wires for electrical connection to the externally generated control signal. This unit does not contain the electromagnet. It primarily serves as a conduit between the control circuitry and electromagnet in a manner which obviates the need for the separately housed electromagnet to have wires extending therefrom for connection to the electrical control circuitry when the electromagnet is to be replaced. The associated housing member which includes the electromagnet includes opposed front and rear surfaces. Releasable mechanical connecting means are provided for securably mounting the first and second housing members together. When so connected, the rear surface of the second housing member will overlie and be in close contact with the front surface of the first housing member which has previously been secured within the door frame and is connected to the control circuitry. The front surface of the first housing member and rear surface of the second housing member include cooperating quick release type frictional contacts, typically a male plug and female socket, so as to provide a secure, but readily releasable electrical path between the first and second housing members. The electromagnet will be positioned along the front surface of the second housing member which, when installed, will advantageously be flush with the door frame. The two housing members of the electromagnetic assembly may be simply connected to each other by a pair of bolts extending through cooperating apertures. To assist in the registry of the two housing members, and in supporting the weight of the second housing member which contains the electromagnet, according to one embodiment, post means project forwardly from the front surface of the first housing member. The post means are intended to receive apertures extending at least partially (and preferably completely) through the second housing member. The forward end of the post is threaded, to receive a nut for fastening the two housings together. Alternatively, the nut can be embodied in the first housing with the bolt(s) extending through the aperture(s) in the second housing to fasten the two housings together. Hence, to replace an electromagnet, the connecting bolts and nuts are disengaged. The electromagnet assembly is then removed. There may be either an automatic disconnection of the plug/socket electrical connection occurring between the two housing assemblies or the plug member in one of the housings manually removed from its complementary socket. To insert a new electromagnet, this procedure is reversed. That is, the electrical connections are made between the plug and socket of the two housings, and the housings are mechanically connected by the threaded engagement of the bolts and nuts to securably mount the two housing members together.

Accordingly, it is an object of the present invention to provide an electromagnetic door lock and release mechanism which readily permits replacement of the electromagnet.

Another object of the present invention is to provide an electromagnetic door lock and release mechanism in which the electromagnet may be replaced and securably mechanically and electrically connected to the system without replacing electrical wire connections to the control circuitry.

A further object of the present invention is to provide such an electromagnetic door lock and release mechanism in which the electromagnet is in a separate housing which is electrically connected to the control circuit via quick release type frictional contacts.

Yet a further object of the present invention is to provide such an electromagnetic door lock and release mechanism in which the quick release frictional contacts comprise a plug extending outward of the electromagnet sub-assembly, with a cooperating socket mounted the door frame sub-assembly for receiving the plug to complete the electrical connection between the electromagnet and the control circuitry.

Still a further object of the present invention is to provide such an electromagnetic door lock and release mechanism in which the quick release frictional contacts comprise a socket recessed within the electromagnetic sub-assembly, with cooperating male contacts mounted in the door frame sub-assembly for entry into the socket to complete the electrical connection between the electromagnetic and the control circuitry.

These as well as other objects of the present invention will become apparent upon a review of the following drawings and detailed description:

BRIEF DESCRIPTION OF THE DRAWINGS

FIG. 3 is a cross-sectional view along lines 3—3 as shown in FIG. 1, and looking in the direction of the arrows.

FIG. 4 is a cross-sectional view along lines 4—4 as shown in FIG. 3, and looking in the direction of the arrows.

DETAILED DESCRIPTION

Figure 1:
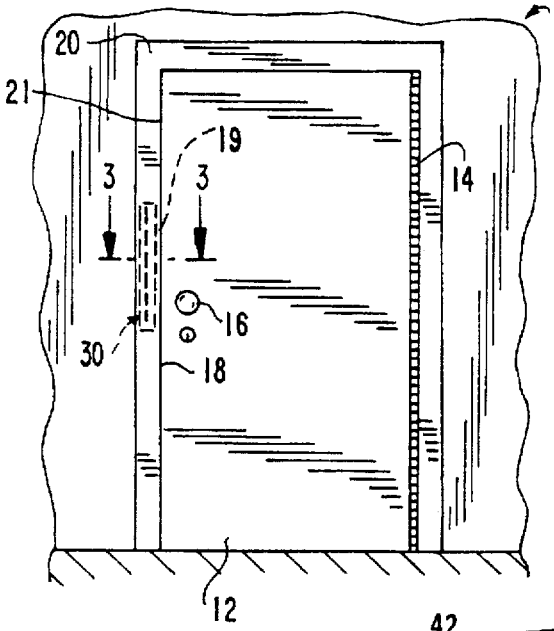
FIG. 1 is a front view showing the general manner in which the electromagnetic door lock and release mechanism may be incorporated into the door assembly.
Figure 2:
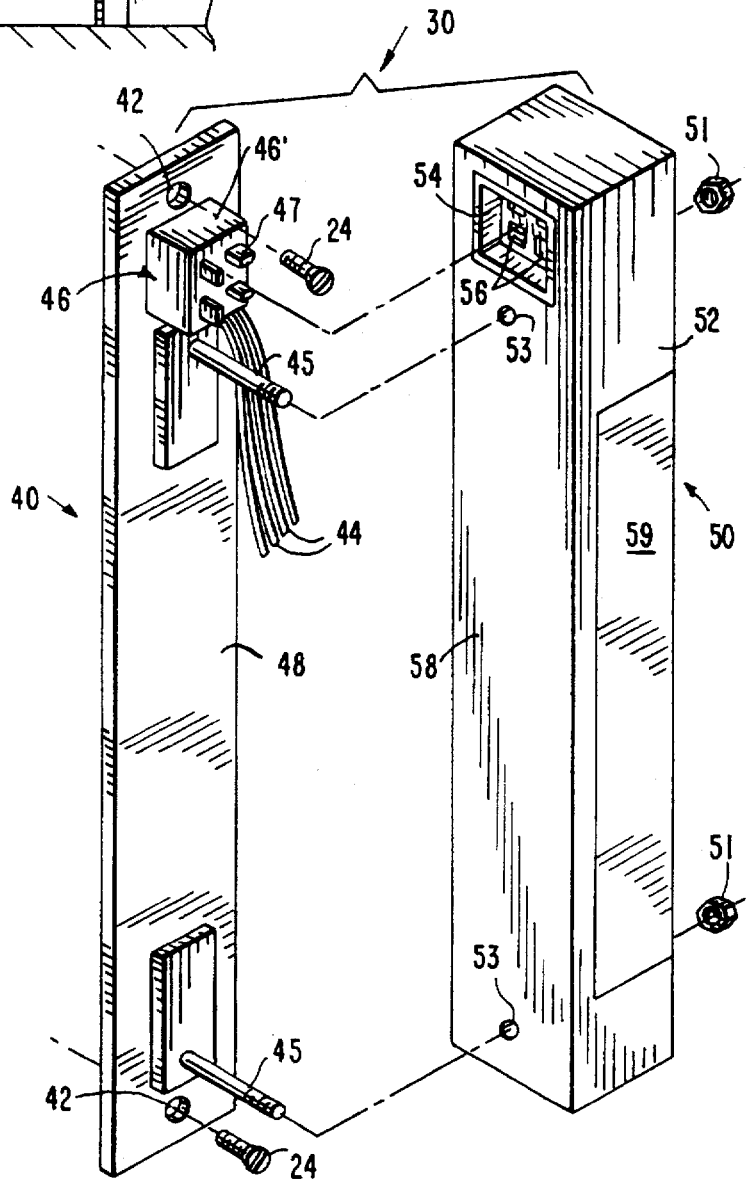
FIG. 2 is a perspective view showing the two housing members which form the electromagnetic door lock and release mechanism of the present invention.

The present electromagnetic door lock and release mechanism is intended to be utilized in conjunction with a remotely controlled door assembly 10, as generally shown in FIGS. 1 and 2. The door assembly includes a door 12 which is hinged to door jamb 20 along its side 14. A handle 16 in proximity to the opposite side 18 of the door is provided for manual moving of the door 12 about its hinged side 14. A remotely activated electromagnetic door lock and release mechanism 30 is installed within surface 21 of the door jamb 20, facing at least a portion 19 of door side 18, which is magnetically responsive to the actuation of an electromagnet with the assembly 30. The actuation of the electromagnet is controlled from a remote location 100. Accordingly, in the 30 well known manner, when it is desired to maintain the door 12 in its closed position, the electromagnet within assembly 30 will be energized from a power source 102 by switch 110 at the remote location 100, to provide electromagnetic engagement between the assembly 30 and door side side portion 19, of a sufficient force to prevent opening of the door 12. When it is desired to permit opening of the door 12, as by allowing permitted egress through the door, the electromagnet within assembly 30 will be de-energized by switch 100 at the external control location. Accordingly, this will permit manual opening of the door 12 about its hinged side 14.

Referring now to the embodiment of FIGS. 2–4, the electromagnetic door lock and release mechanism assembly 30 is comprised of two principal housing members 40 and 50. A recess 22 is provided within the door jamb 20 which faces door side 18 to snugly receive housings 40 and 50, with the substantially planar energizing surface 52 of the electromagnet within housing 50 lying flush with, and being a continuation of, surface 21 of the door jamb. Housing member 40 will be secured within recess 22 as by screw members 24 in apertures 25 provided within the door jamb surface 21 for registry with apertures 42 of the housing 40. Electrical wires 44 are connected to the power source 102 and control switch 100 for the energization and deactivation of the electromagnetic assembly 30. Housing 40 also includes a pair of mounting posts 45 for housing assembly 50. Posts 45 are threaded at least at their forward ends to receive nut fasteners 51, as will subsequently be discussed.

Housing member 40 includes an electrical connector means 46 at its forward surface which is connected to wires 44. In accordance with the present invention, the electrical connector means is in the form of quick release type of electrical connector, which, according to this embodiment, includes a plurality of individual male contacts 47 on a mounting block 46'.

The second housing member 50 includes a pair of apertures 53 which will be in registry with, and are intended to receive, mounting posts 45 of the housing member 40. Housing member 50 also includes a rear recess 54 of the same general shape as mounting block 46' of electrical connector means 47', and is adapted to snugly receive the mounting block 46' when housing member 50 is placed on mounting posts 45 and nut fasteners 51 tightened, with their opposed surfaces 48–58 being in close contact. Recess 54 includes a plurality of spring biased female electrical connectors 56 which are adapted to be in registry with, and engage, the male connectors 47. Hence, when housing members 40 and 50 are connected, an electrical path will be established from the power source 102 and wires 44, through male connectors 47, to the complementary female connectors 56. The female connectors 56 are in turn connected via internal wires 57 to an electromagnet 59 contained within housing member 50.

It should accordingly be appreciated that in order to replace the electromagnetic assembly 50, which includes the actuating electromagnet 59, the maintenance worker need only remove nuts 51 from the mounting posts 45 and slide off housing member 50. This will serve to automatically disconnect electrical contacts 47–56, with energizable contacts 47 being within recess 22. To replace the new electromagnetic assembly 50, the reverse is performed. That is, the apertures 53 of the replacement assembly 50 are first located on mounting posts 45. Assembly 50 is then moved rearwardly to be flush with housing 40, which will automatically provide for the electrical engagement between contacts 47–56. The nuts 51 are then inserted on mounting posts 45 and tightened to provide both a firm mechanical and electrical connection between housing members 40 and 50. Thus, it should be appreciated that the replacement of electromagnetic assembly 50 does not require the services of an electrician, which would be required if the wires 44 would have to be manually disconnected and thereafter connected in order to reinsert the electromagnet within the control circuit.

Figure 5:
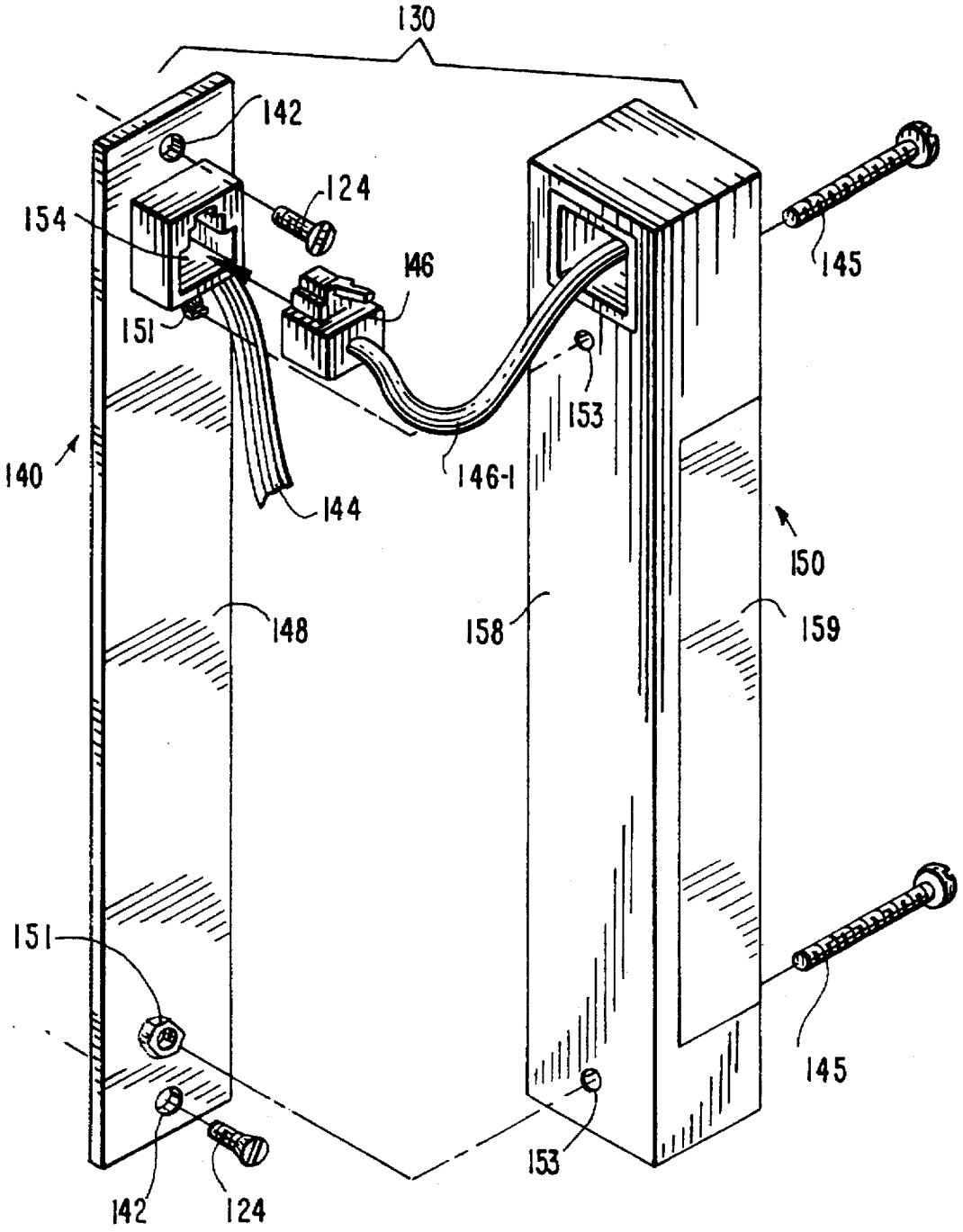
FIG. 5 is a perspective view corresponding to FIG. 2, but showing an alternative embodiment.
Figure 6:
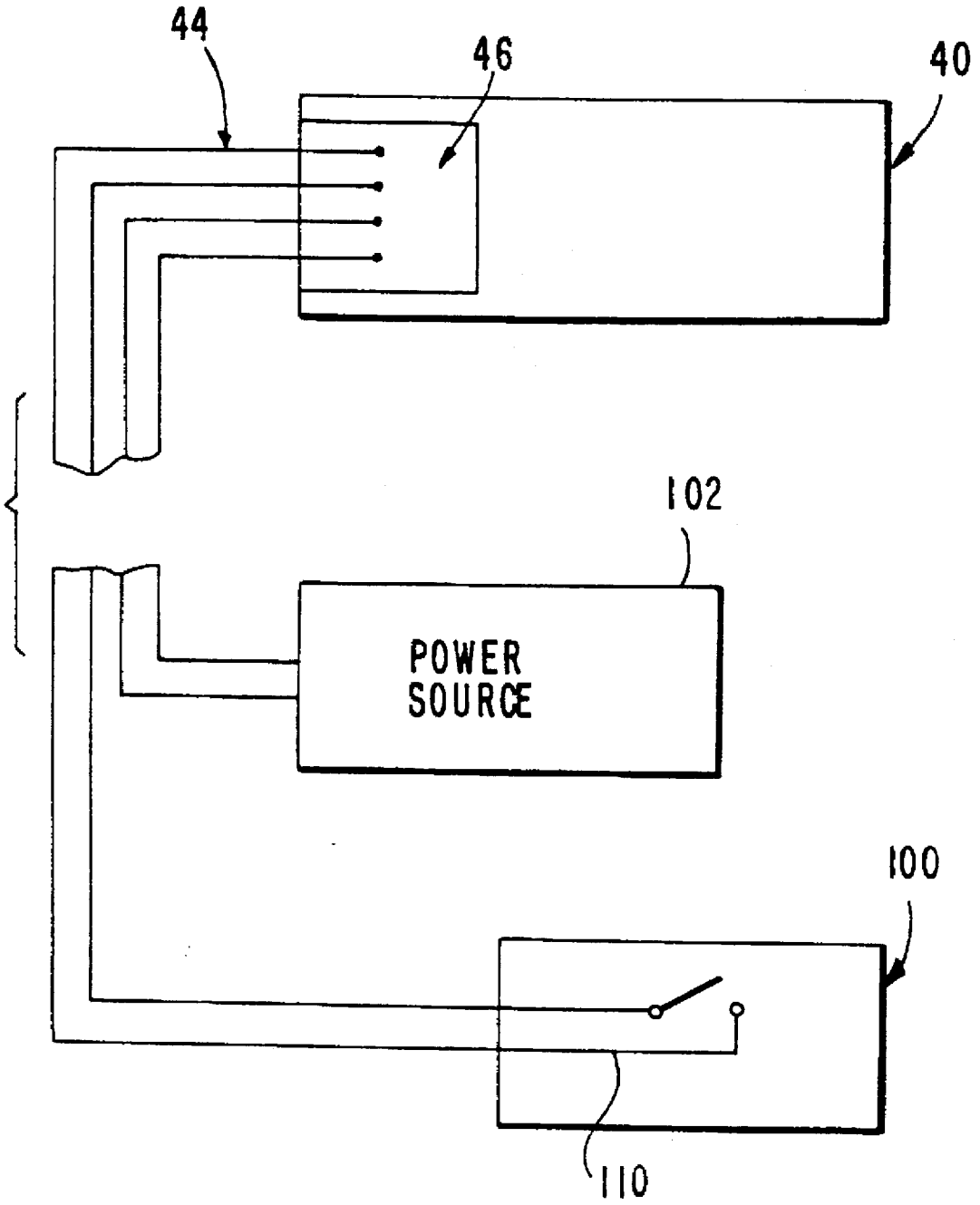
FIG. 6 generally shows the electrical connection of the electromagnetic assembly at the door frame, to the power source and remotely located switch.

The embodiment of FIG. 5 generally corresponds to FIG. 2, in which corresponding components have the 100 prefix and the following differences exist. Housing unit 140, instead of having the connecting bolt member permanently secured thereto, alternatively has a nut member 151 permanently embedded therein, at each of the locations which will be in registry with apertures 153 of housing 150. The electrical connection between sub-assemblies 140 and 150 is provided by telephone type quick connect/disconnect connectors 146/154. Plug 146 extends from the housing member 150 via wire 146-1 and socket 154 is recessed in housing member 140. Accordingly, when it is desired to connect the electromagnet 159 of housing member 150 to the circuit 144, plug 146 is first inserted within socket 154. Apertures 153 are then placed in alignment with the threaded opening of nuts 151 as the surfaces 148 and 158 are positioned in abutting relationship. The bolts 145 are then inserted through openings 153, to engage nuts 151, with bolts 145 tightened to securably fasten the sub assemblies. Hence, the required electrical path will be established from wires 144 through electrical connectors within socket 154 to the complimentary electrical connectors in plug 146. It should accordingly be appreciated that in order to replace the electromagnetic assembly 150, which includes the actuating electromagnetic 159, the maintenance worker need only remove bolts 145, moving assembly 150 outward with respect to assembly 140, and thereafter manually disconnect plug 146 from socket 154.

While preferred embodiments of the present invention have been described in detail, various modifications, alterations and changes may be made without departing from the spirit and scope of the present invention as defined in the following claims.

What is claimed:

1. An electromagnetic door lock and release mechanism comprising:

a) a first housing member adapted to be connected within a door frame, said first housing member including opposed generally planar forward and rear surfaces, first electrical connector means for connection to an externally located electrical control circuit, and a second electrical connector means at its forward surface permanently connected to said first electrical connector means;

b) a second housing member which includes opposed generally planar forward and rear surfaces, said rear surface including third electrical connector means adapted to engage said second electrical connector means to provide an electrical path between said first and second housing members, an electromagnet within said second housing member having a substantially planar energizing surface extending along the forward surface of said second housing member;

c) said second and third electrical connector means being engaged for quick release by a frictional engagement;

d) said second connector means being a male plug carried by a mounting block extending forward of the planar forward surface of said first housing member;

e) said third electrical connector being a female socket, recessed within an opening at the rear surface of said second housing member;

f) said mounting block having a configuration and forward projection closely corresponding to the configuration and recess depth of the opening within said second housing member, such that said mounting block snugly fits within said opening;

g) releasable mechanical connecting means for securably attaching and maintaining said first and second housing member together, with said second and third electrical connecting means providing an electrical path between said electromagnet and said externally located electrical control circuit;

h) said releasable mechanical connecting means including post means extending outward of the forward surface of said first housing member and complementary third aperture means for receiving said post means extending through said second housing member between its forward and rear surfaces;

i) the engagement of said post means and third aperture means providing alignment and mechanical engagement between said first and second housing members, with said mounting block being in registry with and entering the opening of said second housing to provide electrical continuity between said second and third electrical connector means.

2. An electromagnetic door lock and release mechanism according to claim 1, in which said post means is of a length which exceeds the distance between the forward and rear surfaces of said second housing members, such that a free forward end of said post means extends beyond the forward surface of said second housing member, said free end being threaded, and nut fasteners adapted to be threaded onto said forward end for maintaining a secure mechanical connection of said first and second housing members.

3. An electromagnetic door lock and release mechanism according to claim 1 wherein:

the forward and rear surfaces of said first and second housing members, are all of the same area, and in overlying spaced planar relationship, with said front surface of said first housing member being in contact with said rear surface of said second housing member over substantially their entire area.

4. An electromagnetic door lock assembly, comprising in combination:

a) a door frame;

b) a door movably secured to said door frame and selectively movable between an opened and closed condition;

c) an electromagnetic closure and release mechanism mounted in said door frame and including an electromagnet;

d) said door including a magnetically responsive portion, in proximity to said electromagnet to control the closure and release of said door in response to the selective energizing and de-energizing of said electromagnet;

e) said electromagnetic closure and release mechanism including first and second housing members, each having a forward and rear surface, with said electromagnet being within said second housing member;

f) said first housing member mounted in a recess within said door frame, and including first and second electrical connector means, said first electrical connector means adapted to be connected to an externally generated electromagnet control signal, and said second electrical connector means permanently connected to said first electrical connector means;

g) said second electrical connector means being located at said forward surface of said first housing member;

h) said second housing member including a third electrical circuit means at its rear surface, permanently connected to said electromagnet and adapted to engage said second electrical connector means, to with said second electrical connector means provide electrical continuity between said first electrical connector means and said electromagnet;

i) said second and third electrical connector means being engaged for quick release by a frictional engagement, with one of said second and third connector means being a male plug and the other a complementary female socket;

j) releasable mechanical connecting means for securably attaching and maintaining said first and second housing members together;

k) said releasable mechanical connecting means including post means extending outward of the forward surface of said first housing member and complementary third aperture means in said second housing member, in registry with said post means for receiving said post means extending through said second housing member between its forward and rear surfaces;

l) the engagement of said post means and third aperture means providing alignment and mechanical securement between said first and second housing members, with said second and third electrical connector means being in registry, and automatically engaging upon the insertion of said post means in said third aperture means, and movement of said second housing member towards said first housing member.

5. An electromagnetic door lock assembly according to claim 4 wherein:

the rear surface of said second housing member overlies and is in close contact with the forward surface of said first housing member; and said first and second members are both configured to be located within the recess of the door frame, with the forward surface of said second housing member being flush with said door frame and including an energizing surface of said electromagnet adapted to engage said magnetically responsive portion of said door.

6. An electromagnetic door lock assembly according to claim 4, wherein:

said third electrical connector means is a female socket, and said second electrical connector means is a male plug, said female socket located with a recessed opening at the rear surface of said second housing member configured to automatically receive and snugly contain said male plug upon the engagement of said post means and third aperture means.

* * * * *